US006499732B1

(12) United States Patent
Akaba

(10) Patent No.: US 6,499,732 B1
(45) Date of Patent: Dec. 31, 2002

(54) MANUAL FEED APPARATUS IN IMAGE FORMING SYSTEM

(75) Inventor: Hideyuki Akaba, Kawasaki (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/603,618

(22) Filed: Jun. 26, 2000

(51) Int. Cl.[7] ..... B65H 3/44
(52) U.S. Cl. ..... 271/9.09; 271/121; 271/124
(58) Field of Search ..... 271/9.09, 121, 271/124

(56) References Cited

U.S. PATENT DOCUMENTS 4,978,115 A * 12/1990 Sato et al. ..... 271/124
5,273,269 A * 12/1993 Iwanaga ..... 271/124
5,320,337 A * 6/1994 Itoh et al. ..... 271/124
5,326,091 A * 7/1994 Giacometto et al. .... 271/124 X
5,370,381 A * 12/1994 Winship et al. ..... 271/121
5,890,707 A * 4/1999 Allibert et al. ..... 271/9.09

FOREIGN PATENT DOCUMENTS

JP 3-24516 5/1991
JP 2585428 9/1998

* cited by examiner

*Primary Examiner*—David H. Bollinger
(74) *Attorney, Agent, or Firm*—Foley & Lardner

(57) ABSTRACT

There is here disclosed a manual paper feeder attached to an image forming apparatus including at least an image data receiving portion and an image forming device, and the manual paper feeder comprises a manual feed unit for supplying a paper sheet by mounting the paper sheet by a user; and a paper sheet release unit including at least a paper feed roller for carrying the paper sheets mounted in the manual feed unit; a frictional separation member for carrying the paper sheets by the frictional force while holding the manually supplied paper sheets between the frictional separation member itself and the paper feed roller; and a frictional force variable mechanism for changing the frictional force for holding the paper sheet between the paper feed roller and the frictional separation member.

12 Claims, 11 Drawing Sheets

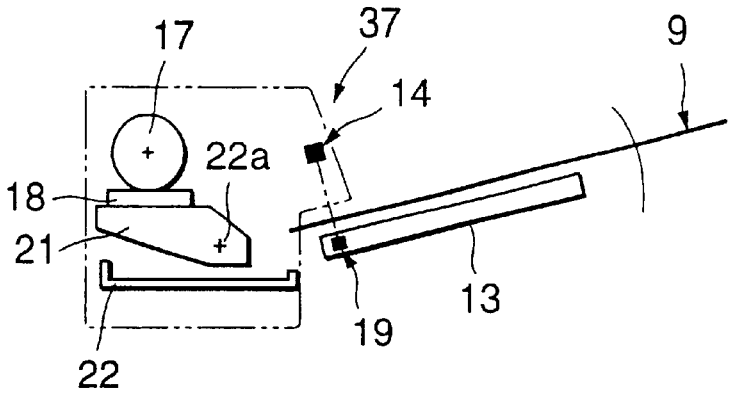
FIG.6
FIG.7A
FIG.7B
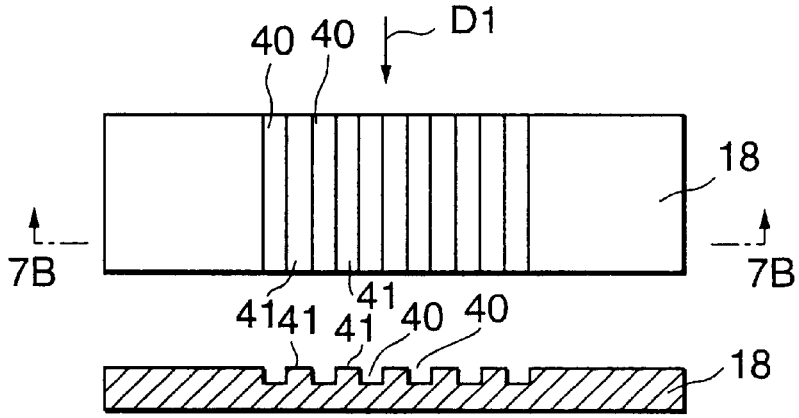
FIG.8A
FIG.8B
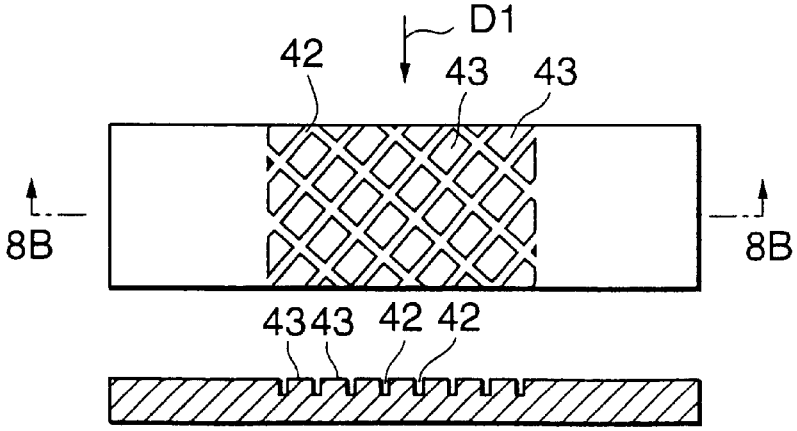

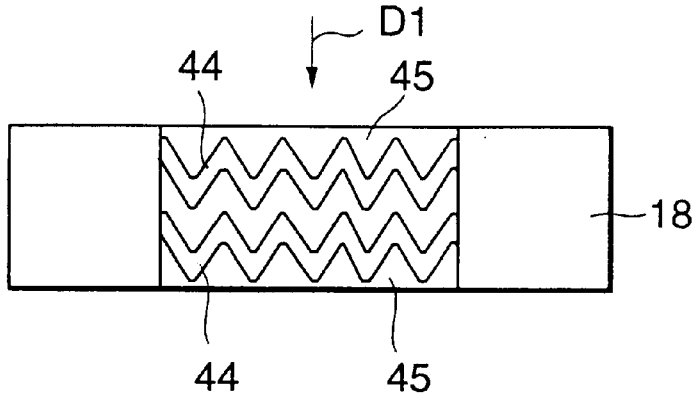
FIG.9
FIG.10A
FIG.10B
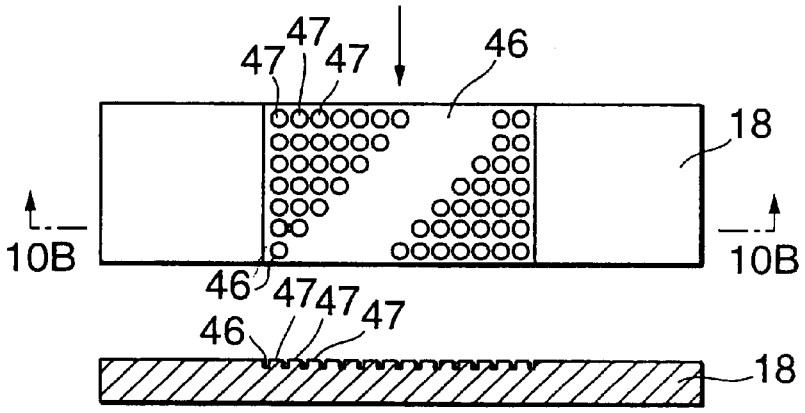
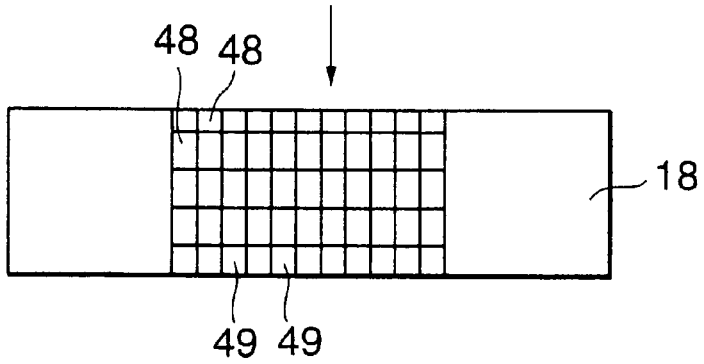
FIG.11

MANUAL FEED APPARATUS IN IMAGE FORMING SYSTEM

BACKGROUND OF THE INVENTION

The present invention relates to a manual paper feeder in an image forming apparatus such as a color plain paper copy machine (which will be abbreviated to PPC -Plane Paper Copy machine-) or a printer which prints and records information from an image information supplying apparatus such as a personal computer (which will be abbreviated to PC-Personal Computer-) or a digital camera on paper sheets such as manually supplied plain paper sheets or OHP sheets having different paper qualities and paper thicknesses.

In the manual paper feeder provided in an image forming apparatus for forming images on the paper sheets, various contrivances have been heretofore made in order to smoothly carry the manually supplied paper sheets to an image forming mechanism such as a photosensitive drum or a transfer roller. Any particular problem does not occur when the number of the manually inserted paper sheets is one, but when a plurality of paper sheets are superimposed on each other in a paper feed portion, the paper sheet to be normally supplied drags another paper sheet under the above paper sheet and it is inconveniently fed together with the lower paper sheet on occasion. As a countermeasure, various separation mechanisms for the paper sheets are provided in the next stage of the paper feed portion of the manual paper feeder, as disclosed in Japanese Patent No. 2655916, Japanese Utility Model Registration No. 2585428 and Japanese Utility Model Publication No. 24516/1991.

As the separation mechanism for the manual paper feeder, a combination of a frictional separation member made of a felt material and a rubber roller is used, but when a paper feed rubber roller having a high friction coefficient is used in order to give a carrying frictional force to the paper sheets to be carried, a friction coefficient $\mu 1$ between the paper feed rubber roller and the paper sheet to be carried and another friction coefficient $\mu p$ between the paper sheets to be carried are larger than a friction coefficient $\mu 2$ between the frictional separation member formed of a felt material and the paper sheet to be carried, so that the paper sheets to be carried cannot be separated from each other one by one and so the plurality of paper sheets are often fed together.

Furthermore, when the frictional separation member is formed of a rubber material in order to prevent the feeding of the plural paper sheets due to the above-described frictional separation member made of the felt material, a friction coefficient $\mu 2'$ between the frictional separation member made of the rubber material and the paper sheet to be carried is larger than the friction coefficient $\mu p$ between the paper sheets to be carried and the friction coefficient $\mu 1$ between the paper feed rubber roller and the paper sheet to be carried, so that there sometimes occurs a problem that the carrying frictional force deteriorates to cause a feeding failure.

SUMMARY OF THE INVENTION

In order to eliminate the above-described problem, an object of the present invention is to provide a manual paper feeder which can prevent the feeding of plural paper sheets or a feeding failure by enabling the variable adjustment of a frictional force between a paper feed roller and a frictional separation member.

To achieve the above object, a manual paper feeder according to a basic concept of the present invention is directed to a manual paper feeder attached to an image forming apparatus comprising at least an image data receiving portion and an image forming device, and this manual paper feeder comprises a manual feed unit for supplying a paper sheet mounted by a user; and a paper sheet release unit including at least a paper feed roller for carrying the paper sheet mounted in the manual feed unit; a frictional separation member for carrying the paper sheet by the frictional force while holding the manually supplied paper sheets between the frictional separation member itself and the paper feed roller; and a frictional force variable mechanism for changing the frictional force for holding the paper sheet between the paper feed roller and the frictional separation member.

Furthermore, a manual paper feeder according to a different aspect of the present invention is directed to a manual paper feeder attached to an image forming apparatus comprising at least an image data receiving portion and an image forming device, and this manual paper feeder comprises a manual feed unit for supplying paper sheets mounted by a user; and a paper sheet release unit including at least roller paper feeding means for carrying the paper sheets mounted in the manual feed unit; frictional separating means for carrying the paper sheets by the frictional force while holding the manually supplied paper sheets between the frictional separating means itself and the roller paper feeding means; and frictional force variable means for changing the frictional force for holding the paper sheet between the roller paper feeding means and the frictional separating means.

BRIEF DESCRIPTION OF THE DRAWINGS

In the accompanying drawings:

FIG. 6 is a front view showing a primary part of a manual paper feeder according to a fourth embodiment of the present invention;

FIG. 7A and FIG. 7B are a plane view and a cross sectional view showing a first concrete example of a frictional separation member;

FIG. 8A and FIG. 8B are a plane view and a cross sectional view showing a second concrete example of the frictional separation member;

FIG. 9 is a plane view showing a third concrete example of the frictional separation member;

FIG. 10A and FIG. 10B are a plane view and a cross sectional view showing a fourth concrete example of the frictional separation member;

FIG. 11 is a plane view showing a fifth concrete example of the frictional separation member;

DESCRIPTION OF THE EMBODIMENTS

Figure 1A:
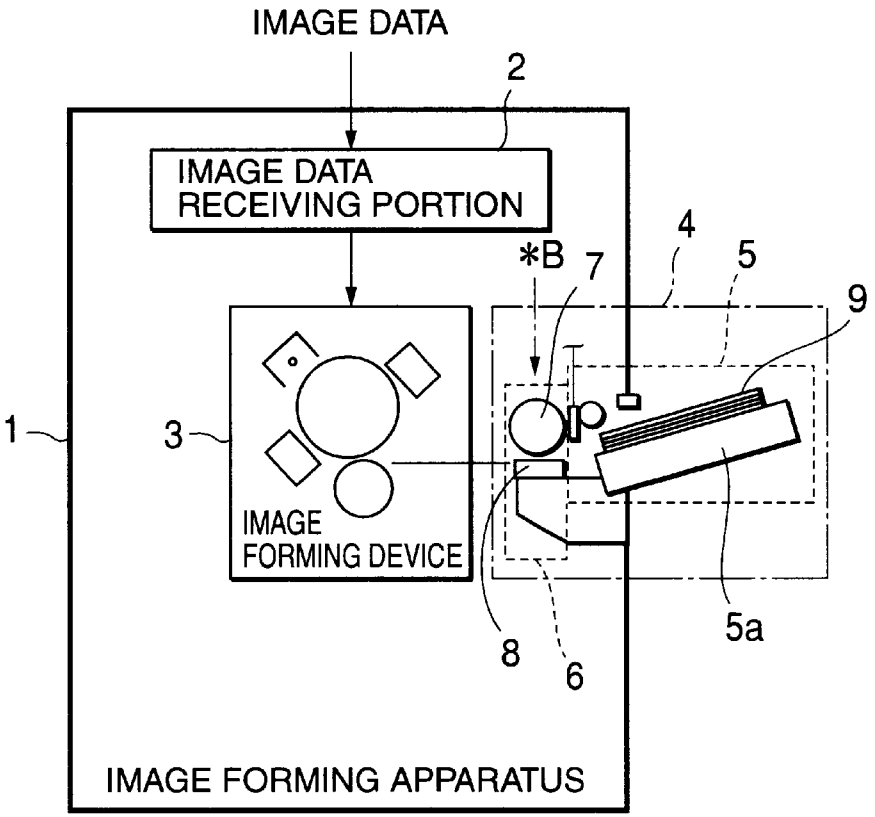
FIG. 1A, FIG. 1B and FIG. 1C are an explanatory view, a plane view and a front view, respectively, showing a schematic structure of a manual paper feeder according to a first embodiment of the present invention.

Preferred embodiments of an image forming apparatus according to the present invention will now be described in detail hereinafter with reference to the accompanying drawings. Referring to FIGS. 1A to IC, description will first be given on an image forming apparatus according to a first embodiment as a basic concept of the present invention.

As shown in FIG. 1A, an image forming apparatus 1 according to the first embodiment basically includes: an image data receiving portion 2 for receiving image data; an image forming device 3 for forming an image based on the received image data to be outputted; and a manual paper feeder 4 attached to the image forming device 3. Further, the manual paper feeder 4 includes: a manual feed unit 5 provided with a mounting base 5*a* for supplying a paper sheet 9 such as copy paper or an OHP (Over Head Projector) sheet mounted by a user; and a paper sheet release unit 6 for releasing the paper sheet 9 mounted on the mounting base 5*a* of this manual feed unit 5 to be supplied to the image forming device 3.

This paper sheet release unit 6 includes a paper feed roller 7 for carrying the paper sheet 9; a frictional separation member 8 for carrying the paper sheet 9 by the frictional force while holding the manually supplied paper sheet 9 between the frictional separation member 8 itself and the paper feed roller 7; and a frictional force variable mechanism for changing the frictional force for holding the paper sheet 9 between the paper feed roller 7 and the frictional separation member 8.

Figure 1B:
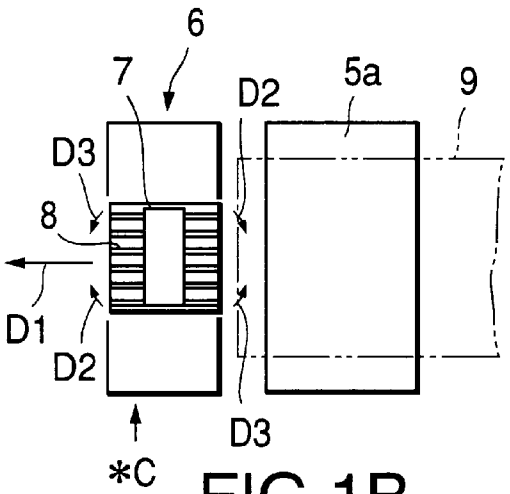
Figure 1C:
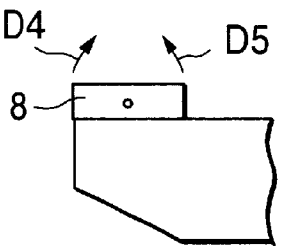

FIG. 1B shows the state of the mounting base 5*a* and the paper sheet release unit 6 seen from a ⊃B direction in FIG. 1A, and the positional relationship between the paper feed roller 7 and the frictional separation member 8 of the paper sheet release unit 6 can be easily understood from this drawing. Although the detailed explanation of the drawing will be described later, the frictional separation member 8 is provided with the frictional force variable mechanism for giving forces in directions of arrows D2 and D3 to a carrying direction D1 for the paper sheet 9 in FIG. 1B. It is to be noted that, as the concept of this frictional force variable mechanism, the frictional separation member 8 may be swiveled in the directions of arrows D4 and D5 with respect to a horizontal plane to change the frictional force as illustrated in FIG. 1C seen from a ⊃C direction of FIG. 1B.

Figure 2:
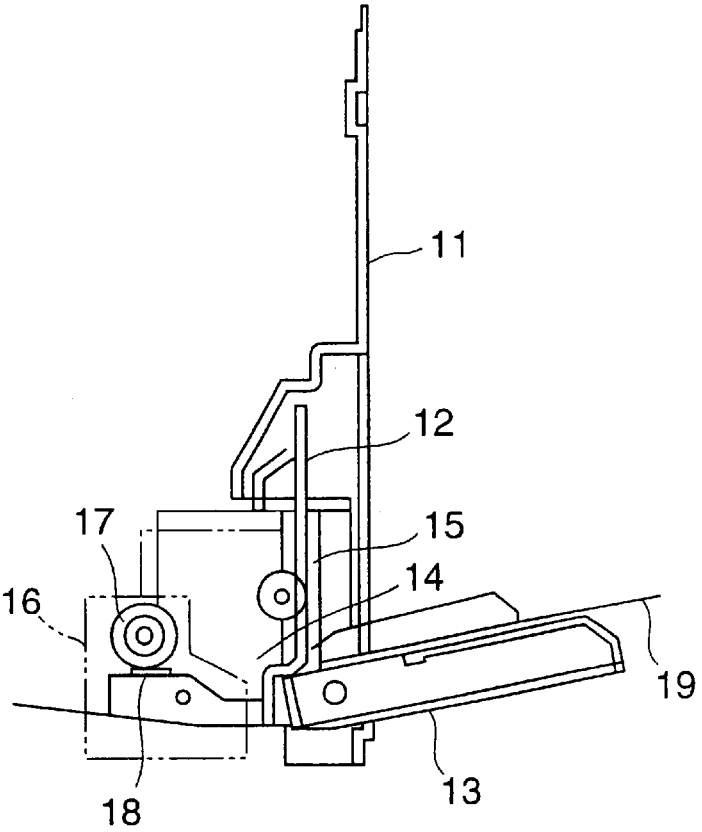
FIG. 2 is a front view showing a manual paper feeder according to a second embodiment of the present invention.

Detailed description will now be given as to a manual paper feeder for an image forming apparatus according to a second embodiment of the present invention as a further concrete structure with reference to FIGS. 2 to 4. FIG. 2 is a cross sectional view showing an overall structure of a manual paper feeder 12 in an image forming apparatus 11 according to the second embodiment. In FIG. 2, the image forming apparatus 11 includes a manual paper feeder 12, and the manual paper feeder 12 comprises: a manual feed tray 13; a paper sheet existence/absence detection sensor 14; a pickup roller 15; and an absorbed paper separation mechanism 16. The separation mechanism 16 includes a paper feed roller 17 and a frictional separation member 18. Reference numeral 9 is a pack of paper sheets such as plain paper or an OHP film mounted on the manual feed tray 13.

In such a structure, when a pack of the paper sheets 9 to be carried to the image forming apparatus 11 is mounted on the manual feed tray 13 of the manual paper feeder 12, the paper sheet existence/absence detection sensor 14 senses existence/absence of the mounted paper sheet. When it is determined that the paper sheet 9 is mounted, the pickup roller 15 moves down by control of the main body to come into contact with the uppermost paper sheet of the mounted paper sheet 9, and the paper sheet 9 is carried to a position of the separation mechanism 16 by driving the roller 15 to rotate. The paper sheet 9 carried to the separation mechanism 16 is released and separated from each other one by one by the paper feed roller 17 of the separation mechanism 16 and the frictional separation member 18 to which a predetermined pressure is applied.

Figure 3:
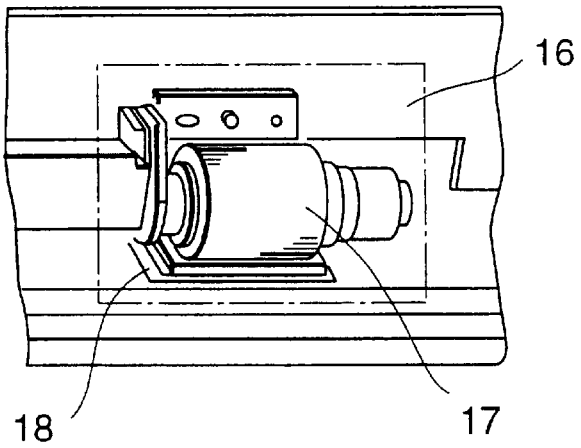
FIG. 3 is a perspective view showing a primary part of the manual paper feeder according to the second embodiment of the present invention.

FIG. 3 is an enlarged perspective view showing the detail of the separation mechanism 16 provided to the manual paper feeder 12. As shown in FIG. 3, the separation mechanism 16 is constituted by combined use of the paper feed roller 17 having a high friction coefficient and the frictional separation member 18 formed of a rubber material, and a plurality of slits are formed to the frictional separation member 18 of the rubber material along the direction for carrying the paper sheet 9.

When the paper sheet 9 is carried to the separation mechanism 16, the relationship of "$\mu 1 > \mu 2 > \mu p$" is established among a friction coefficient al between the paper feed roller 17 and the paper sheet 9 to be carried, a friction coefficient $\mu p$ between the paper sheets 9 to be carried, and a friction coefficient $\mu 2$ between the paper sheet 9 to be carried and the frictional separation member 18 made of the rubber material, and the paper sheets 9 can be hence separated from each other one by one to be carried.

When the frictional separation member 18 is formed of a rubber material having a high friction coefficient, the above-described expression is established since the friction coefficient $\mu 2$ between the paper sheet 9 and the frictional separation member 18 takes precedence of the friction coefficient $\mu p$ between the paper sheets 9 to be carried, and the paper sheet 9 can be stably and assuredly separated and carried.

In addition, since the later-described slits as a frictional force adjustment mechanism are formed on the surface of frictional separation member 18 made of the rubber material with which the paper sheet comes into contact, the contact area between the frictional separation member 18 and the paper sheet 9 is reduced to decrease the friction coefficient. This can prevent the carriage failure of the paper sheet 9.

Figure 4:
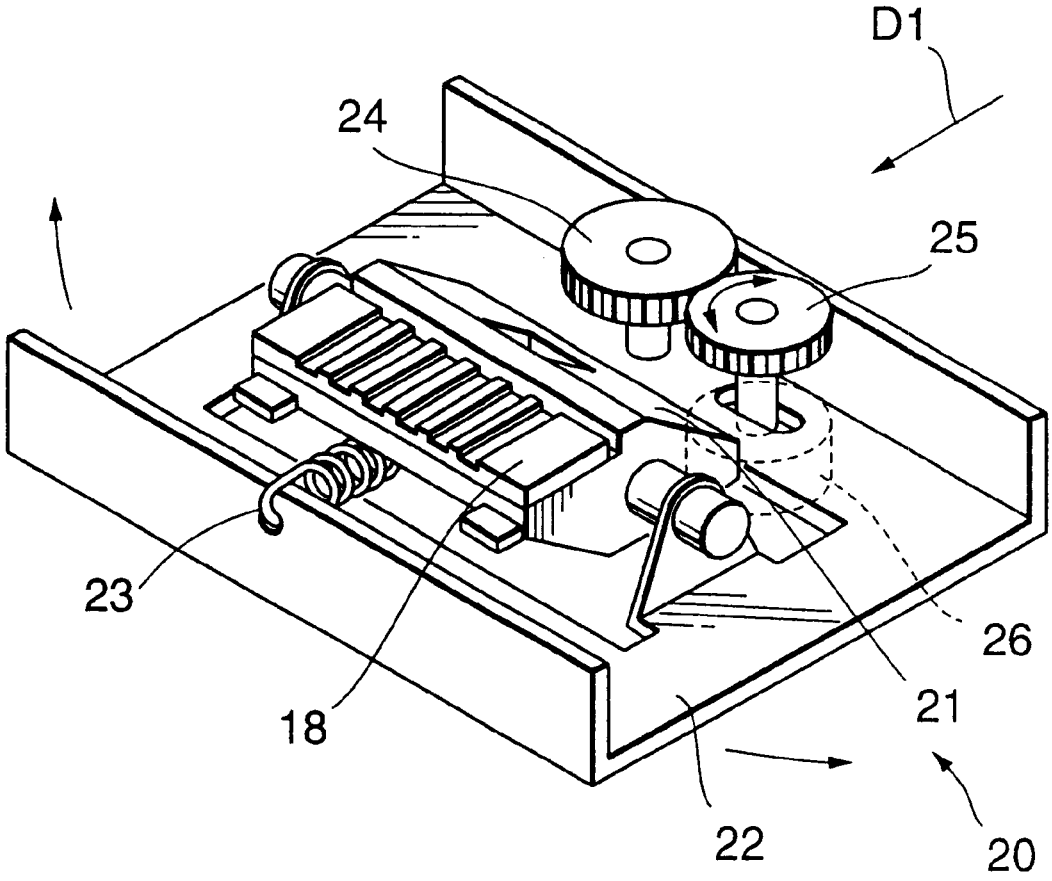
FIG. 4 is a perspective view showing a primary part of the manual paper feeder according to the second embodiment of the present invention.

FIG. 4 shows a variable mechanism portion 20 for the frictional separation member 18. As shown in FIG. 4, the variable mechanism portion 20 is constituted by: a holder 21 having the frictional separation member 18 provided thereto; a support portion 22 for supporting this holder 21; a pressure spring 23 for applying a fixed pressure to the frictional separation member 18; a first gear capable of changing the support portion 22 in the direction of an arrow; a second gear 25; and an adjustment knob 26 for adjusting a variable amount of the gears 24 and 25.

Since the friction coefficient of the paper sheet 9 largely varies depending on types of the paper sheet 9, when the friction coefficient is high as a thick paper sheet, the carriage failure of the paper sheet 9 can be prevented by reducing the contact area of the paper sheet 9 and the frictional separation member 18 to decrease the friction coefficient, and the paper sheet 9 can be thereby stably separated and carried. On the contrary, when the friction coefficient is low as a thin paper sheet 9, the contact area of the paper sheet 9 and the frictional separation member 18 is increased to enhance the friction coefficient by changing the friction coefficient of the frictional separation member 18 to be higher. This can prevent the plural paper sheets 9 from being carried at the same time even if the paper sheet 9 is thin, and the paper sheet 9 can be stably separated and carried.

The variable adjustment portion 20 can confirm a type of the paper sheet 9 on which an end user intends to form an image, and an end user himself/herself can adjust an appropriate variable amount with which the feeding failure or the feeding of plural paper sheets can be avoided in accordance with a type of the paper sheet 9 to be used. In addition, by incorporating the above-described adjustment operation by manual manipulation in control of the main body of the image forming apparatus 11, the variable amount of the variable adjustment portion 20 can be semiautomatically adjusted on the control panel.

Figure 5:
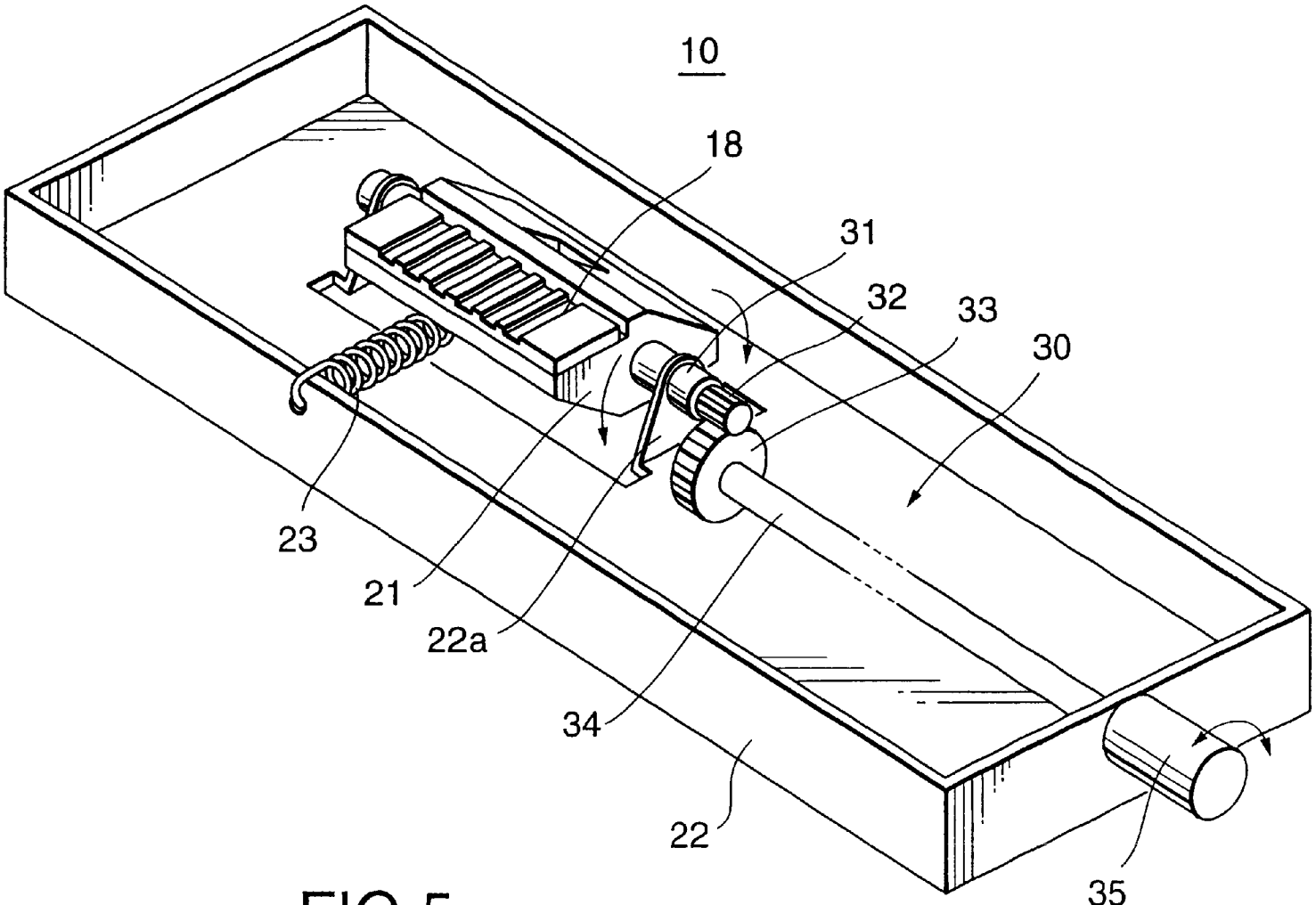
FIG. 5 is a perspective view showing a primary part of a manual paper feeder according to a third embodiment of the present invention.
Figure 12:
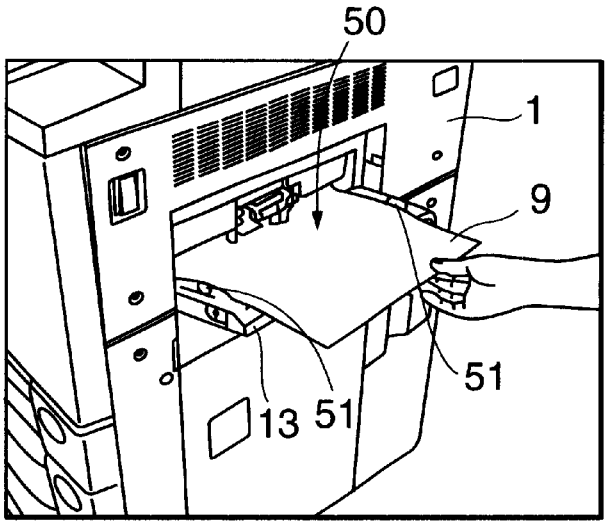
FIG. 12 is an explanatory view for explaining the operation of a manual paper feeder according to a fifth embodiment according to the present invention.
Figure 13:
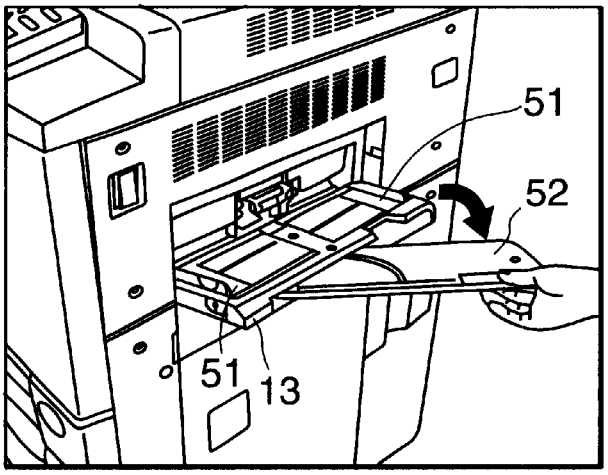
FIG. 13 is an explanatory view for explaining the operation of the manual paper feeder according to the fifth embodiment of the present invention.

A method for variably setting the frictional force by the variable mechanism for varying the frictional separation member 18 will now be described in conjunction with the manual paper feeder according to third to fifth embodiments. The manual paper feeder according to the third embodiment shown in FIG. 5 is a concrete example for setting the frictional separation force by manual manipulation. Constituent parts having the same reference numerals used in FIGS. 1 to 4 are constituent parts which are the same as or correspond to the constituent parts in the manual paper feeder according to the first and second embodiments.

In FIG. 5, the manual paper feeder 10 according to the third embodiment includes: a frictional separation member 18 supported by a support portion 22*a* of a unit bottom plate 22; a pressure spring 23 for applying a fixed pressure to the frictional separation member 18; and a variable mechanism portion 30 for variably adjusting the frictional separation force of the frictional separation member 18. The variable mechanism portion 30 has: a cylindrical portion 31 integrally provided to the holder 21 to which the frictional separation member 18 is fixed on the base end side; a small-diameter gear portion 32 fixed to the end surface of the cylindrical portion 31; and a discoid largediameter gear portion 33 meshed with the gear portion 32; and a swiveling shaft 34 having one end surface fixed to the center of the gear portion 33; and a knob 35 fixed to the other end surface of the shaft 34.

The knob 35 protrudes toward the outside beyond the side wall surface of the tray 13, and the contact angle and the contact area of the frictional separation member 18 with respect to the paper sheet can be variably adjusted when a user pinches and adjusts the protruding knob 35 to swivel, and a desired frictional force can be freely selected. In this manner, according to the manual paper feeder of the third embodiment, the frictional force of the frictional separation member 18 with respect to the paper sheet can be freely set by the manual operation of a user in accordance with types of the paper sheet, thereby obtaining such an advantage as that the frictional force with the conformity can be set in accordance with the paper quality.

As opposed to the third embodiment adopting the manual setting, description will now be give as to a manual paper feeder according to a fourth embodiment which can set the frictional force of the frictional separation member by automatic setting with reference to FIG. 6. In FIG. 6, the manual paper feeder according to the fourth embodiment comprises: a holder 21 pivoted by a support portion 22*a* of a unit bottom plate 22; a frictional separation member 18 integrally fixed to the holder 21; a pushing roller 17 for separating the paper sheet 9 between the pushing roller 17 itself and the frictional separation member 18 to carry the paper sheet 9 to the image forming apparatus side; and a tray for mounting the paper sheet 9 thereon, and a paper type detection mechanism 37 as a structure for detecting a type of the paper sheet 9 is provided between the tray 13 and the support portion 22 as a characteristic of the fourth embodiment.

The paper type detection mechanism 37 is constituted by a transmission sensor and determines a paper type of the paper sheet 9 by detecting the intensity of light emitted from a light emission portion 14 and passed through the paper sheet 9 by a photo acceptance portion 19. The paper type determined by the paper type detection mechanism 37 is transmitted as a signal output to a non-illustrated arithmetic calculation portion and, when the paper type of the paper sheet 9 is determined in this portion, the pushing force of the pushing roller 17 or the surface contact force of the frictional separation member 18 and the like is automatically adjusted by a control portion (not shown) in accordance with the determined paper type, and a desired frictional separation force with respect to the paper sheet 9 can be set.

Here, as a structure common to the above-described first to fourth embodiments and the later-described fifth embodiment, a concrete structural example of a surface frictional force adjustment portion in the frictional separation member 18 will now be described with reference to FIGS. 7A to 11.

FIG. 7A and FIG. 7B show the frictional separation member 18 according to the first concrete example. The frictional separation member 18 according to the first concrete example includes straight slits 40 formed along a direction D1 for carrying the paper sheet, and the top faces of protruding portions 41 other than the slits 40 have the frictional force between the top faces themselves and the paper sheet.

Therefore, the frictional force of the frictional separation member 18 between this frictional separation member 18 itself and the paper sheet can be adjusted by changing an angle of the slit 40 to the carrying direction D1 or varying an angle of the top faces of the protruding portions 41 in the horizontal direction by a non-illustrated variable adjustment portion. It is to be noted that FIG. 7B is a cross sectional view taken along the 7B—7B line in FIG. 7A.

FIG. 8A and FIG. 8B show the frictional separation member 18 according to a second concrete example. The frictional separation member 18 according to the second concrete example has grooves in two directions which are respectively inclined with respect to the direction D1 for carrying the paper sheet and orthogonal to each other, and a part other than the groove 42 remains as a protruding portion 43.

Therefore, the frictional force of the frictional separation member 18 relative to the paper sheet can be adjusted by changing an angle of the slit 42 to the carrying direction D1 or varying an angle of the top surface of the protruding portion 43 in the horizontal direction by a non-illustrated variable adjustment portion. It is to be noted that FIG. 8B is a cross-sectional view taken along the 8B—8B line in FIG. 8A.

FIG. 9 shows a frictional separation member 18 according to a third concrete example. The frictional separation member 18 according to the third concrete example has an axial line in a direction orthogonal to the direction D1 for carrying the paper sheet and includes corrugated slits 44 formed in the zigzag manner along this axial line, thereby providing the frictional force to the top face of the protruding portion 45 other than the corrugated slit 44 relative to the paper sheet.

Thus, the frictional force of the frictional separation member 18 relative to the paper sheet can be adjusted by changing an angle of the slit 44 relative to the carrying direction D1 or varying an angle of the top face of the protruding portion 45 in the horizontal direction by a non-illustrated variable adjustment portion.

FIG. 10A and FIG. 10B show a frictional separation member 18 according to a fourth concrete example. The frictional separation member 18 according to the forth concrete example includes roundlet protruding portions 47 protruding in a plurality of columns in a direction along the direction D1 for carrying the paper sheet and in another direction orthogonal to the former, and a slit 46 other than these protruding portions 47. The top faces of the protruding portions 47 other than the slit 46 have the frictional force between the top faces themselves and the paper sheet.

Therefore, the frictional force between the frictional separation member 18 and the paper sheet can be adjusted by changing an angle of the slit 46 relative to the carriage direction D1 or varying an angle of the top face of the protrusions 47 in the horizontal direction by a non-illustrated variable adjustment portion. It is to be noted that FIG. 10B is a cross 20 sectional view taken along the 10B—10B line in FIG. 10A.

At last, FIG. 11 shows a frictional separation member 18 according to a fifth concrete example. The frictional separation member 18 according to the fifth concrete example includes alternate slits 4 so formed as to correspond to black parts of a chess board in a direction along the carriage direction D1 for the paper sheet and in a direction orthogonal to the former, and the top faces of protruding portions 49 other than these slits 48 have the frictional force between the top faces themselves and the paper sheet.

Therefore, the frictional force of the frictional separation member 18 between this frictional separation member 18 itself and the paper sheet can be adjusted by changing an angle of the slits 48 relative to the carriage direction D1 or varying an angle of the top faces of the protruding portions 49 in the horizontal direction by a non-illustrated variable adjustment portion.

A manual paper feeder according to a fifth embodiment according to the present invention will now be described with reference to FIGS. 12 to 24. Although the third embodiment shows an example where the frictional separation force variable mechanism is set by the manual operation and the fourth embodiment illustrates an example where the frictional separation force variable mechanism is configured by the automatic setting, description will be given on an example where the frictional force of the frictional separation member is set by using a setting panel provided to an image forming apparatus main body such as a copier in the fifth embodiment.

A manuscript is first mounted on a non-illustrated glass surface to start the copying operation. As shown FIG. 12, a paper sheet 9 is mounted on a manual feed tray 13 of a manual paper feeder 50 of an image forming apparatus 1 to slide a slide frame 51, thereby adjusting the paper feed position. In this case, when setting the paper sheet to be fed which has a large size such as A3 or A4-R, a paper holder 52 accommodated in the manual feed tray 13 is pulled out, and the paper is then set.

Figure 14:
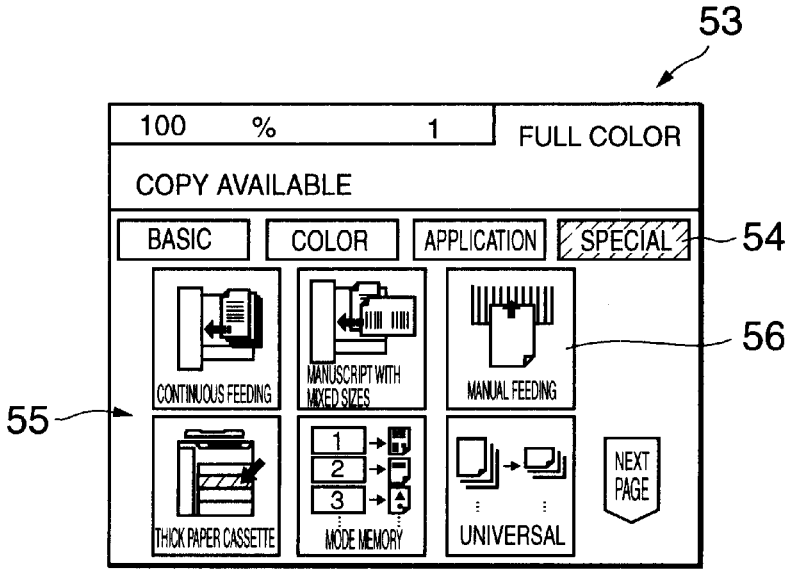
FIG. 14 is an explanatory view for explaining the operation of the manual paper feeder according to the fifth embodiment of the present invention.
Figure 15:
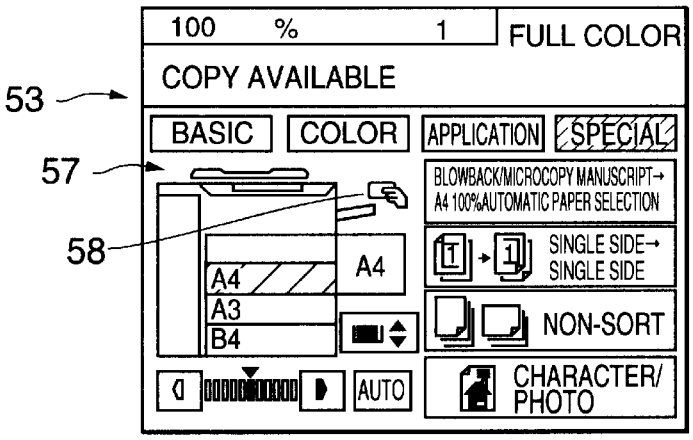
FIG. 15 is an explanatory view for explaining the operation of the manual paper feeder according to the fifth embodiment of the present invention.

FIG. 14 shows a setting panel 53 provided to the image forming apparatus 1. When operating the copier by the manual paper feed mode, a "special" button 54 is pressed to display a special menu 55, and the "special" button 56 is selected and pressed from this special menu 55. In this case, even if a basic menu screen 57 is displayed as shown in FIG. 15, since a manual feed mode mark 58 is displayed in the basic menu screen 57 when the paper sheet 9 is set on the manual feed tray 13, pressing the mark 58 shifts the screen to the manual feed mode screen shown in FIG. 14.

Figure 16:
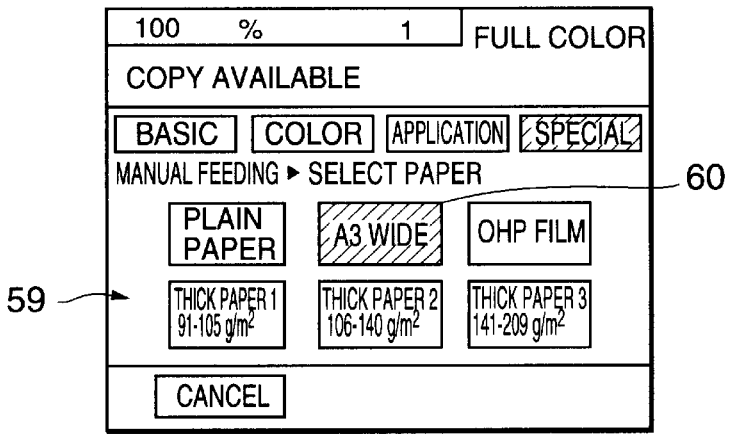
FIG. 16 is an explanatory view for explaining the operation of the manual paper feeder according to the fifth embodiment of the present invention.
Figure 17:
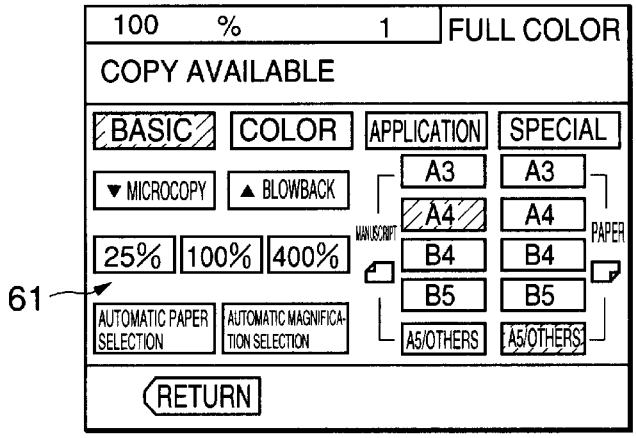
FIG. 17 is an explanatory view for explaining the operation of the manual paper feeder according to the fifth embodiment of the present invention.
Figure 18:
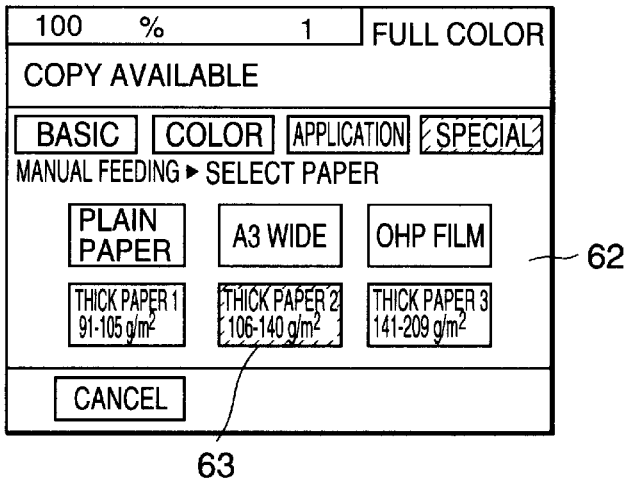
FIG. 18 is an explanatory view for explaining the operation of the manual paper feeder according to the fifth embodiment of the present invention.

As shown in FIG. 16, a selection screen 59 for a paper size or a paper type is displayed and a plain paper button or a "A3 wide" button 60 is selected and pressed. Further, if the manuscript size is different from the manual paper feed size, a paper size selection screen 61 such as shown in FIG. 17 is displayed and the manuscript size and the paper size are respectively selected and pressed. For example, when the manuscript size is A4 and the paper size is a special size, two buttons displayed in black reverse such as shown in FIG. 17 are respectively selected and pressed.

Although not illustrated, a number of copies is designated and a start button is pressed. At this time, if the manual feed paper jam indication flashes, the paper is once pulled out and the paper is again set in a manual feed guide. Upon completion of copying, since a lamp of a reset button flashes, the flashing reset button is pressed or 45 seconds passes to automatically cancel the manual feed mode.

When copying on a thick paper sheet or a label sheet, a dedicated paper sheet is used to perform copy as preferably as possible. It is noted that the time of approximately two to three minutes to change a mode setting is required in case of varying the paper type or the paper size. When selecting a type of a thick paper sheet, the type can be freely selected by pressing a button corresponding to each paper type, i.e., "thick paper 1", "thick paper 2" and "thick paper 3" as in the selection screen 62 shown in FIG. 18. In this case, when the "thick paper 2" is to be selected, a "thick paper 2" button 63 is pressed. The paper types of these thick paper sheets are classified by a paper weight with respect to a predetermined area, and copying on an optimum paper type is enabled by selecting a desired type of the thick paper sheet and then pressing the start button.

Figure 19:
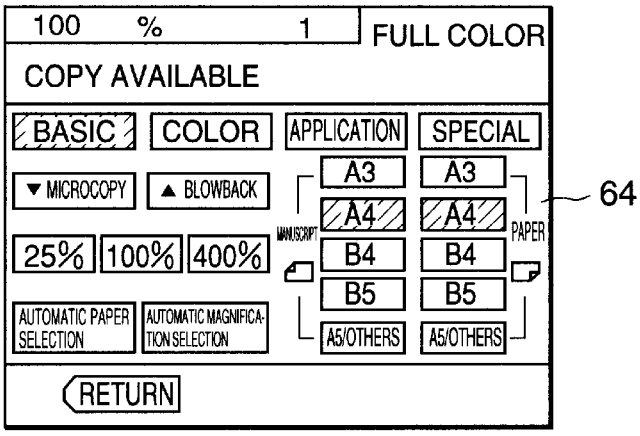
FIG. 19 is an explanatory view for explaining the operation of the manual paper feeder according to the fifth embodiment of the present invention.

In regard to how to use the manual feed copy (a thick paper, an OHP film), a manual feed size is selected in the screen 64 shown in FIG. 19 and any other copy mode is also set if necessary. The paper size corresponding to a set easy size is selected and the manuscript size is also selected, thereby setting a copy magnification and the like. Incidentally, when setting the manuscript of AR-R size or B5-R size or the paper size, the "A4" button or the "B5" button is pressed twice, respectively. When the paper size is not set, the automatic magnification selection is canceled.

Figure 20:
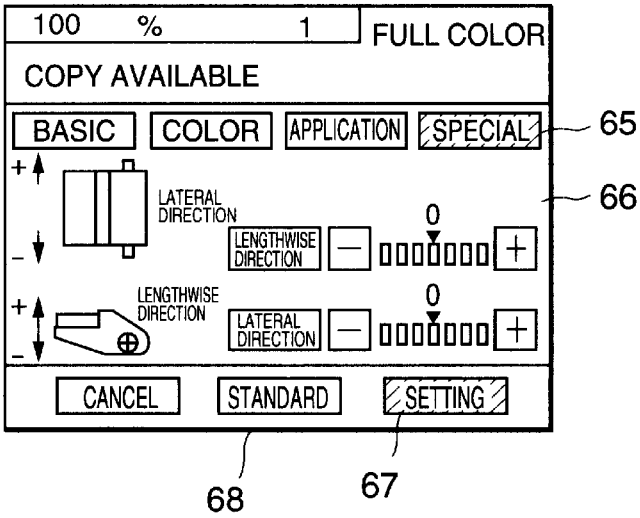
FIG. 20 is an explanatory view for explaining the operation of the manual paper feeder according to the fifth embodiment of the present invention.
Figure 21:
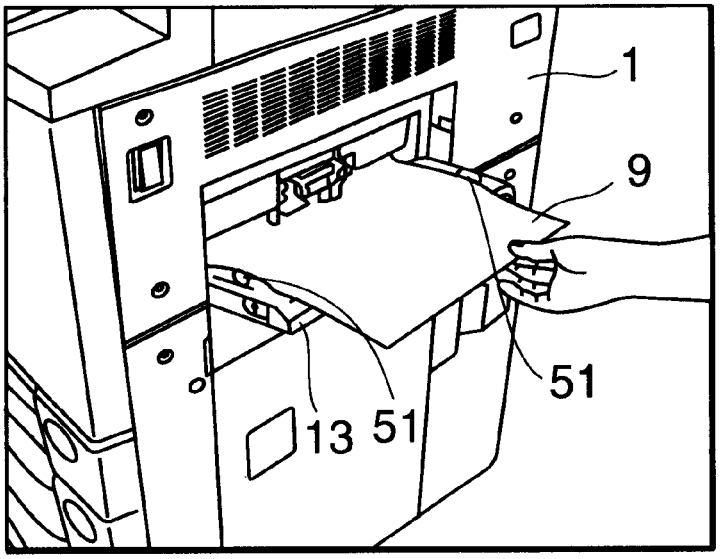
FIG. 21 is an explanatory view for explaining the operation of the manual paper feeder according to the fifth embodiment of the present invention.
Figure 22:
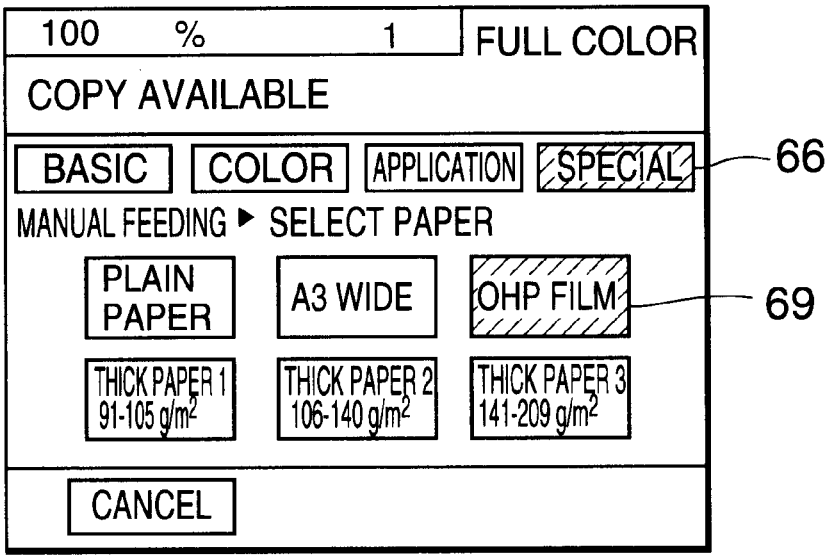
FIG. 22 is an explanatory view for explaining the operation of the manual paper feeder according to the fifth embodiment of the present invention.

After selecting the paper size, a fine adjustment mode for the frictional separation member is selected for adjustment. As shown in FIG. 20, when the "special" button 65 is pressed, the selection screen 66 is displayed; a "set" button 67 is pressed when manually setting; or a "standard" button 68 is pressed when the standard setting is possible. The "set" button 67 is used to select a mode in which a user can arbitrarily perform adjustment, and the "standard" button 68 corresponds to a default value (center value) at shipment of the machine body. Copy can be conducted by setting a number of copies and then pressing the start button.

At last, giving description as to a case where an OHP film is manually fed to carry out copying, a paper size is set by adjusting the slide frame 51 and an "OHP film" button 69 is pressed by pressing the "special" button 66. As a paper size, the A4 size is automatically selected. A number of copies is subsequently designated. A number of copies allowed in one operation is set to 20. When copying more than 20 sheets, the OHP film is replenished in a dedicated cassette to conduct copying. Finally, the start button is pressed.

Figure 23:
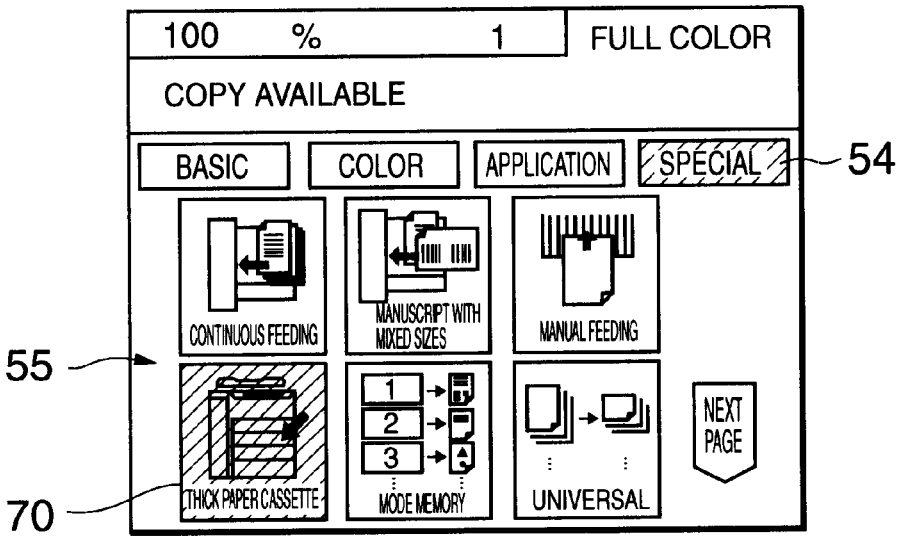
FIG. 23 is an explanatory view for explaining the operation of the manual paper feeder according to the fifth embodiment of the present invention.
Figure 24:
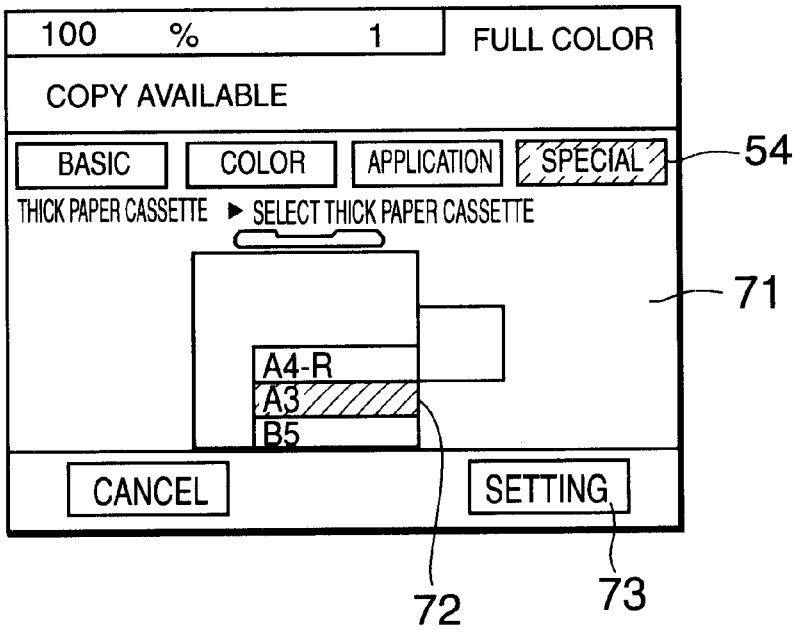
FIG. 24 is an explanatory view for explaining the operation of the manual paper feeder according to the fifth embodiment of the present invention.

Explaining a case where resupply is carried out from the dedicated cassette for the thick paper/OHP film to perform copying, the thick paper is set in the dedicated cassette for the thick paper (105 g/m$^2$). Changing the paper size for the dedicated cassette for the thick paper is similar to the operation procedure for changing the regular cassette paper size. As to the thick paper whose weight greatly exceeds 105/m$^2$, only the manual paper feed is possible. A number of sheets which can be set is approximately 400. As shown in FIG. 23, the special button 54 is pressed to display the special menu screen 55, and a thick cassette button 70 is pressed. The dedicated cassette for the thick paper is set in the display screen 71 shown in FIG. 24. Since the cassette cannot be set in the uppermost stage, one of the second, third and fourth cassettes is selected. When the A3 size is set, the second cassette from the bottom is designated. At last, a set button 73 is pressed to carry out copying.

As described above, the mode of the manual paper feeder can be also set by using the setting panel of the copier main body according to the fifth embodiment. In this case, although the setting method similar to the prior art is used for setting in the setting panel, the process for setting the optimum frictional force in accordance with the paper type while fine-adjusting the frictional force of the frictional separation member by a variable adjustment portion after setting is a structure characteristic to the invention of this application.

As described above, according to the manual paper feeder of the present invention, since the relationship "$\mu 1 > \mu 2 > \mu p$" can be established between the friction coefficient $\mu 1$ between the paper feed roller and the paper sheet to be carried, the friction coefficient $\mu p$ between the paper sheets to be carried, and the friction coefficient $\mu 2$ between the paper sheet to be carried and the frictional separation member, the paper sheets are separated one by one to be carried when carrying the paper sheets toward the image forming apparatus, thereby preventing the plural paper sheets from being carried at the same time or avoiding the feeding failure.

In addition, since providing the variable adjustment mechanism for the frictional force to the frictional separation member can manage each friction coefficient in accordance with various paper sheet types, and a difference in friction coefficient between the paper sheets can be quickly detected and absorbed by adjusting the surface contact ratio of the frictional separation member and the paper sheet, thereby stably separating and carrying the various kinds of paper sheets as compared with the prior art paper sheet separation mechanism.

What is claimed is:

1. A manual paper feeder attached to an image forming apparatus comprising at least an image data receiving portion, and an image forming device, said manual paper feeder comprising;

a manual feed unit for supplying a paper sheet by mounting said paper sheet by a user; and a paper sheet release unit including at lest a paper feed roller for carrying said paper sheet mounted on said manual feed unit, a frictional separation member for carrying said paper sheet by frictional force in which said paper sheet is held in place between the frictional separation member and said paper feed roller; and a frictional force variable mechanism for changing the frictional force for holding said paper between said paper feed roller and said frictional separation member, wherein said paper feed roller comprises a skin friction member in which the peripheral surface of said roller is covered with a material that includes a rubber material; and wherein said frictional separation member includes slits for reducing a contact area between the frictional separation member and said paper sheet.

2. The manual paper feeder according to claim 1, wherein said slits as said surface frictional force adjustment portion are a plurality of straight slits formed in a direction which coincides with a direction for carrying said paper sheet.

3. The manual paper feeder according to claim 1, wherein said slits as said surface frictional force adjustment portion have a cross slit shape formed so as to constitute a lattice shape by the inclination of the respective slits at a predetermined angle with respect to said direction for carrying said paper sheet and by the intersection of the respective slits.

4. The manual paper feeder according to claim 1, wherein said slits as said surface frictional force adjustment portion are a plurality of corrugated slits whose axial line coincides with a direction orthogonal to said direction for carrying said paper sheet and which are formed in a zigzag shape.

5. A manual paper feeder attached to an image forming apparatus comprising at least an image data receiving portion and an image forming device, said manual paper feeder comprising:

a manual feed unit for supplying a paper sheet by mounting said paper sheet by a user; and a paper sheet release unit including at least a paper feed roller for carrying said paper sheet mounted on said manual feed unit, a frictional separation member for carrying said paper sheet by frictional force in which said paper sheet is held in place between the frictional separation member and said paper feed roller; and a frictional force variable mechanism for changing the frictional force for holding said paper between said paper feed roller and said frictional separation member, wherein said paper feed roller comprises a skin friction member in which the peripheral surface of said roller is covered with a material that includes a rubber material; and wherein said frictional separation member includes a plurality of protruding portions which protrude in a predetermined shape with a predetermined rule.

6. The manual paper feeder according to claim 5, wherein said protruding portions have a roundlet emboss or a roundlet recessed pattern such that said frictional force is provided to said paper sheet by way of said roundlet emboss or said roundlet recessed pattern.

7. The manual paper feeder according to claim 5, wherein said protruding portions have a checked pattern such that said frictional force is provided to said paper sheet by way of said checked pattern.

8. A manual paper feeder attached to an image forming apparatus comprising at least an image data receiving portion and an image forming device, said manual paper feeder comprising:

a manual feed unit for supplying a paper sheet by mounting said paper sheet by a user; and a paper sheet release unit including at least a paper feed roller for carrying said paper sheet mounted on said manual feed unit, a frictional separation member for carrying said paper sheet by frictional force in which said paper sheet is held in place between the frictional separation member and said paper feed roller; and a frictional force variable mechanism for changing the frictional force for holding said paper between said paper feed roller and said frictional separation member, wherein said frictional force variable mechanism is constituted by a carriage direction angle change portion capable of adjusting said surface frictional force at a predetermined angle with respect to said carriage direction of said paper sheet, by changing an angle by which a top surface of said frictional separation member makes contact with said paper sheet.

9. A manual paper feeder attached to an image forming apparatus comprising at least an image data receiving portion and an image forming device, said manual paper feeder comprising:

a manual feed unit for supplying a paper sheet by mounting said paper sheet by a user; and a paper sheet release unit including at least a paper feed roller for carrying said paper sheet mounted on said manual feed unit, a frictional separation member for carrying said paper sheet by frictional force in which said paper sheet is held in place between the frictional separation member and said paper feed roller; and a frictional force variable mechanism for changing the frictional force for holding said paper between said paper feed roller and said frictional separation member, wherein said frictional force variable mechanism is constituted by a surface inclination angle change portion capable of changing a surface inclination angle with respect to a surface level at which said paper sheet is carried.

10. A manual paper feeder attached to an image forming apparatus comprising at least an image data receiving portion and an image forming device, said manual paper feeder comprising:

a manual feed unit for supplying a paper sheet by mounting said paper sheet by a user; and a paper sheet release unit including at least a paper feed roller for carrying said paper sheet mounted on said manual feed unit, a frictional separation member for carrying said paper sheet by frictional force in which said paper sheet is held in place between the frictional separation member and said paper feed roller; and a frictional force variable mechanism for changing the frictional force for holding said paper between said paper feed roller and said frictional separation member, wherein said frictional force variable mechanism is constituted by a manual operation mechanism including an operation knob and a gear.

11. A manual paper feeder attached to an image forming apparatus comprising at least an image data receiving portion and an image forming device, said manual paper feeder comprising:

a manual feed unit for supplying a paper sheet by mounting said paper sheet by a user; and a paper sheet release unit including at least a paper feed roller for carrying said paper sheet mounted on said manual feed unit, a frictional separation member for carrying said paper sheet by frictional force in which said paper sheet is held in place between the frictional separation member and said paper feed roller; and a frictional force variable mechanism for changing the frictional force for holding said paper between said paper feed roller and said frictional separation member, wherein said frictional force variable mechanism is constituted by an automatic setting frictional force variable mechanism for adjusting the frictional force of said surface frictional force adjustment portion by automatic operation; and wherein said automatic setting frictional force variable mechanism adjusts a guide angle of said frictional force adjustment portion by a predetermined angle with respect to said direction for carrying said paper sheet.

12. The manual paper feeder according to claim 11, wherein said frictional force variable mechanism is constituted by an automatic setting frictional force variable mechanism for adjusting the frictional force of said surface frictional force adjustment portion by automatic operation; and wherein said automatic setting frictional force variable mechanism adjusts the frictional force between said paper sheet and said surface frictional force adjustment portion in accordance with conditions of a paper quality, a paper thickness and others of said paper sheet.

* * * * *